US005275381A

United States Patent [19]

Cluff et al.

[11] Patent Number: 5,275,381

[45] Date of Patent: Jan. 4, 1994

[54] WIRE FENCING WITH DECORATIVE SLATS THAT PROVIDE ESSENTIALLY COMPLETE PRIVACY

[76] Inventors: Robert G. Cluff, 4983 Cahoon Cir., Taylorsville, Utah 84118; Gerald J. McClaughlan, 3330 W. 3615 South, West Valley City, Utah 84119

[21] Appl. No.: 765,967

[22] Filed: Sep. 26, 1991

[51] Int. Cl.[5] ..... B21F 29/00

[52] U.S. Cl. ..... 256/35; 256/19; 24/336; 24/587

[58] Field of Search ..... 256/35, 34, 32, 19; 245/11; 24/336, 587

[56] References Cited

U.S. PATENT DOCUMENTS

| | | | |
|---|---|---|---|
| 2,097,988 | 11/1937 | Ross et al. | 24/587 X |
| 2,760,759 | 8/1956 | Rice | 256/34 |
| 3,225,922 | 12/1965 | Straight | 24/336 X |
| 3,712,590 | 1/1973 | Tochner et al. | 256/34 |
| 4,010,517 | 3/1977 | Kapstad | 24/336 x |
| 4,723,761 | 2/1988 | Cluff | 256/34 |
| 4,995,591 | 2/1991 | Humphrey et al. | 256/34 |

FOREIGN PATENT DOCUMENTS

| | | | |
|---|---|---|---|
| 3422049 | 12/1985 | Fed. Rep. of Germany | 256/32 |
| 188207 | 11/1922 | United Kingdom | 256/34 |

*Primary Examiner*—Randolph A. Reese
*Assistant Examiner*—Christopher J. Novosad
*Attorney, Agent, or Firm*—Terry M. Crellin

[57] ABSTRACT

Wire fencing having a plurality of elongate picket members that lie adjacent to a side face of the chain link fencing so as to be substantially superposed over the fencing. Engagement members extend from the back faces of the picket members to project into the fencing and engage respective mounting members positioned within the fencing or on the opposite side face of the fencing. The interengagement of the engagement members and the mounting members holds the picket members firmly in place on the side of the fencing.

20 Claims, 6 Drawing Sheets

WIRE FENCING WITH DECORATIVE SLATS THAT PROVIDE ESSENTIALLY COMPLETE PRIVACY

BACKGROUND OF THE INVENTION

Field of the Invention

The present invention relates to wire fences, such as chain link fencing, which have a plurality of decorative, elongate slats that also provide privacy by blocking the view through the fence. Heretofore, the slats have generally been woven through the links of the chain link fabric of the fence. More particularly, the present invention relates to improved means for arranging decorative slats in the form of decorative pickets on the side of wire fences, including chain link fences, so as to essentially block visual observation through the fence, i.e., providing essentially complete privacy. Further, the present invention relates to an improved means for locking and retaining adjacent slats in a uniform position along the fence, wherein the locking means provides interlocking engagement between the slats and the wire fencing.

State of the Art

It is well known to insert slats in chain link fences to provide increased privacy and to improve the appearance of the fence. Unfortunately, there are two somewhat related, serious problems encountered in using slats in chain link fencing. First, the slats have a tendency to shift longitudinally after being inserted in the wire fabric of the chain link fence so as to become disarranged and uneven. Disarranged, uneven slats greatly impair the appearance of the fence. In addition, the loosely positioned slats are easy prey for vandals. The slats are, unfortunately, easily removed from the fence by vandals.

The second problem is that of a lack of complete privacy. When the slats are positioned side-by-side within adjacent channels in the chain link fencing, an elongate open space is formed between the adjacent slats. This elongate space is needed to accommodate the intertwined wires of the chain link fabric, and there is no way that slats can be inserted in the channels formed by the chain link fabric to avoid the open spaces between adjacent slats. Under the best of conditions, at least about ⅓ of the area of the fence is formed by these open spaces, and one can easily view through the open spaces. Complete privacy is not possible.

Several methods have been proposed to alleviate the first problem. The slats have been secured to the chain links in the fence by using staples, nails and other fasteners. In addition, systems have been proposed for interlocking the slats with channel members or elongate rigid connecting members which run along the length of the fence and which engage the slat members. The installation of such systems is a tedious, time consuming, costly operation. Prior to two U.S. patents which have been recently issued to me, no inexpensive, expedient means had been proposed to effectively cope with the vandalism problem. Some of the prior patent literature suggest complex systems which to some degree alleviates the vandalism problem, but as stated previously, these systems are unfortunately rather costly and require tedious, time consuming installation. Representative U.S. Patents which have been directed to retaining slats in position in chain link fences are:

| | | |
|---|---|---|
| 2,760,759 | 3,037,593 | 4,085,954 |
| 2,802,645 | 3,069,142 | 4,512,556 |

In two previous patents of one of the inventors herein (U.S. Pat. Nos. 4,723,761 and 4,725,044) there are disclosed novel means of retaining slats within the chain link fabric using clip members which engage the slats and prevent the slats from moving within the chain link fencing. In U.S. Pat. No. 4,725,044, a system is disclosed in which the clip members interconnect a respective end of a slat to a rail positioned adjacent to the end of the slat.

In U.S. Pat. No. 4,995,591 there is disclosed chain link fencing employing slats that have an open notch cut through one of the broad sides and extending into the lateral edges of the slat closely adjacent to an end of the slat. When the end of the slat is pushed into an elongate rail having two opposing sides that form an elongate opening therebetween, a lip on one of the sides of the rail engages the notch in the slat. Engagement is made along the entire length of the notch across the entire width of the slat. This engagement has been found to be generally operable, but because the engagement centers on the central axis of the slat, the slat can be turned and disengaged from the slat. In addition, the broad notch across the entire broad side of the slat weakens the slat at the notch considerably. The weakening of the slat at the notch unfortunately allows the slat to deform at the notch and disengage from the rail.

In copending application Ser. No. 07/604,256, filed Nov. 7, 1990, there is disclosed an improved means of interlocking the rail to the slat in which engagement means are formed integrally on at least one of the opposite side edges of mutually respective ends of the slats to form a locking barb or element at the side edge of the slats. Preferably, engagement means are formed integrally at both of the opposite side edges of the slats to form two distinct, separate locking barbs or elements at the opposite edges of the slats. A locking rail is positioned along the mutually respective ends of the slats, wherein the two distinct, separate locking barbs of the slats make double, distinct, separate interlocking engagement with the rail so as to retain the slats at a uniform position along the fencing and locking the slats into the fence to thwart vandalism. The engagement of the slat to the rail is much stronger than with the systems of the prior art mentioned above.

Unfortunately, the second problem mentioned above, i.e., the lack of privacy due to open longitudinal spaces existing between the slats that are inserted into the channels of the chain link fabric, is not addressed by the prior art. There is a complete lack of any teaching in the prior art of being able to utilize slats in a chain link fence so as to obtain essentially complete privacy, that is so that one cannot see through the openings between the slats on the fence.

Objectives

A principal objective of the present invention is to provide a novel wire fence system using picket-like members positioned on the side face of the wire fencing, wherein the picket-like members have means for interengaging the wire fencing for support, and further wherein the resulting fence resembles a picket fence and provides essentially complete privacy.

A particular objective of the present invention is to provide such a system that is applicable to chain link wire fencing wherein elongate mounting members are inserted in the channels of the chain link fabric or positioned on the other side face of the chain link fabric such that there is interlocking engagement between the elongate picket members positioned on the outside of the chain link fabric and the mounting members to hold the pickets firmly in place on the side face of the chain link fencing. The picket members and the mounting members overlap to provide essentially complete privacy.

SUMMARY OF THE INVENTION

The above objectives are achieved in accordance with the present invention by providing a wire fence wherein a plurality of elongate mounting members are provided for securely holding elongate picket members to the fencing such that the picket members lie along at least one of the external side faces of the wire fencing. With conventional wire fences of the chain link type, the mounting members may comprise slats or rails, woven flatwise, in spaced, parallel arrangement, through channels formed by the links of the chain link fabric of the chain link fence. Such mounting members can be spaced so that there is at least one channel that does not contain a mounting member spaced between adjacent channels having mounting members inserted therein. The mounting members are received in the channels of the chain link fabric as is well known in the art. The mounting members are retained within the chain link fabric as are slats or rails of prior art systems. However, without any further means of securing the mounting members in the fabric of the fencing, they can be pulled longitudinally from the chain link fabric. The problem with vandalism due to rails or slats being pulled from the chain link fabric has been recognized and various means have been proposed to alleviate the problem as pointed out hereinbefore.

In accordance with the present invention, elongate picket members are provided that lie along one of the external sides of the wire fencing. Engagement means are provided for engaging the picket members to respective mounting members along the length of the picket member. The engagement means can comprise a series of spaced tabs or projections extending from the opposite sides of the picket members. The tabs or projections extend into the wire fence and make engagement with the mounting members to hold the picket members in place. The spaced tabs or projections preferably have barbs formed thereon which make locking engagement with apertures that are provided in the mounting members for receiving the tabs or projections.

When the fencing is of the chain link type, the picket members preferably have a width sufficient to extend between adjacent mounting members that can be woven in the chain link fabric or positioned on the opposite side face of the fencing. When the mounting members comprise slats woven in the chain link fabric, the picket members will generally have a length essentially the same as the mounting members, i.e., the slats. Alternatively, the pickets can be somewhat longer than the mounting members, i.e., the slats, such that the picket members extend slightly from the top of the chain link fabric.

When the picket member is engaged with the respective mounting members, it is held securely to the face of the wire fence and cannot be removed. The mounting members, including those that can be woven in chain link type fencing and those that are positioned on the opposite side of any type wire fencing including chain link fencing, provide firm mounting support for the picket members, and the interengagement between the picket members and the mounting members prevent the removal of pickets or mounting members from the fence. An ideal combination is accordingly achieved in which the picket members resemble pickets of a conventional picket fence, and the picket members and the mounting members further combine to block essentially all sight through the fence as well as interlock with each other to provide a system in which neither the picket members or the mounting members can be removed from the fence by vandals.

Additional objects and features of the present invention will become apparent from the following detailed description, taken together with the accompanying drawings.

THE DRAWINGS

Preferred embodiments of the present invention representing the best modes presently contemplated of carrying out the invention are illustrated in the accompanying drawings, in which.

Figure 2:
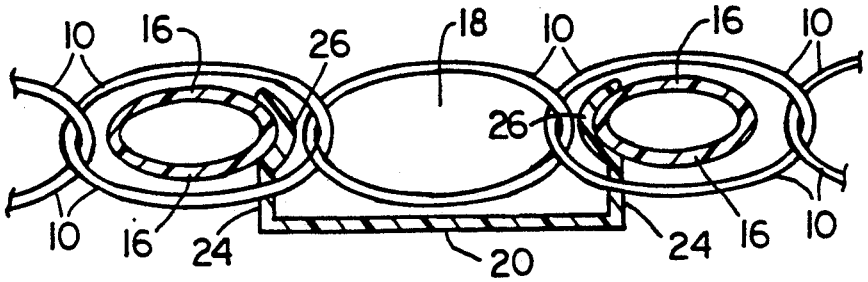
FIG. 2 is a horizontal cross section taken on line 2—2 of FIG. 1 showing one embodiment of the picket members interengaged with the slats.
Figure 10:
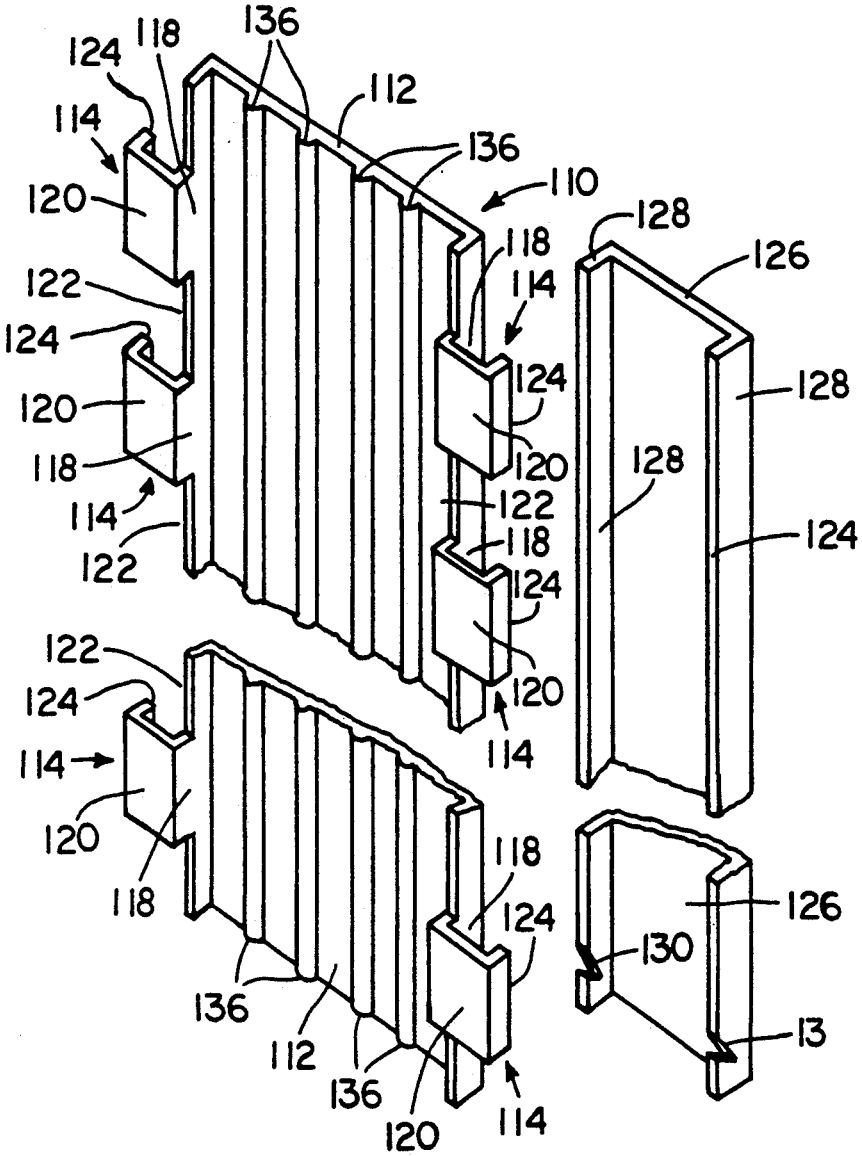
FIG. 10 is a fragmentary, exploded pictorial of another preferred embodiment of a picket and a slat in accordance with the present invention.
Figure 11:
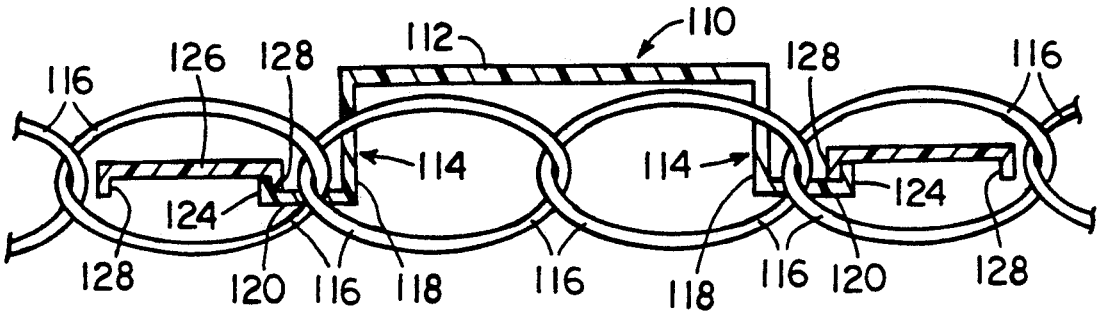
Figure 12:
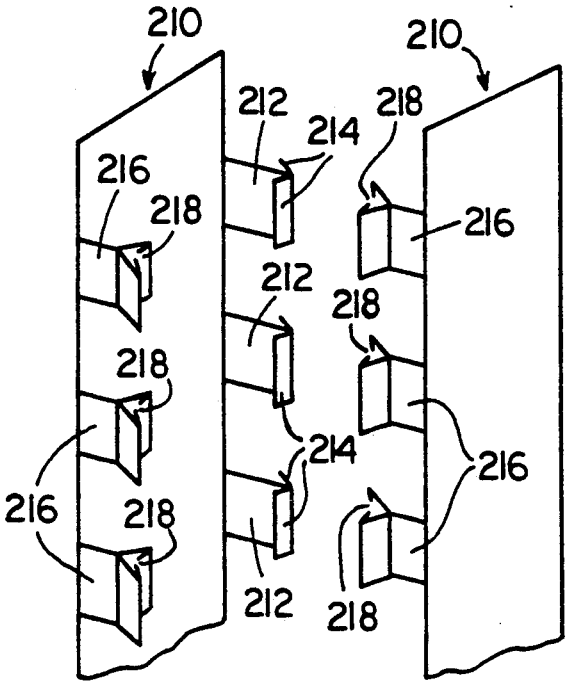
Figure 14:
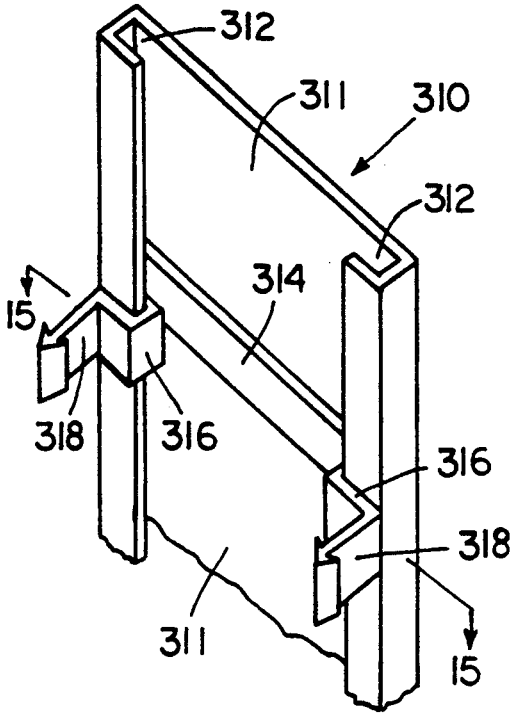
Figure 13:
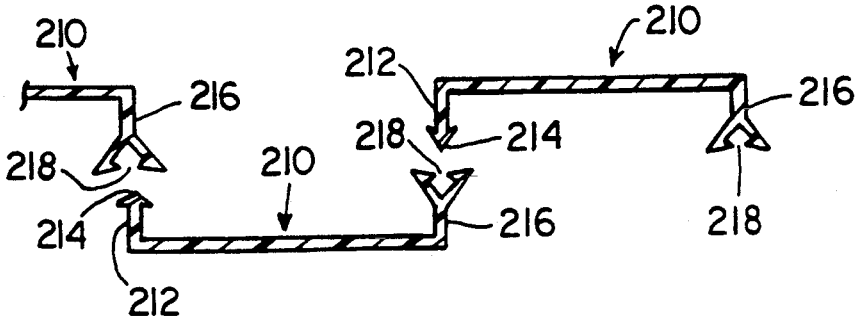
Figure 16:
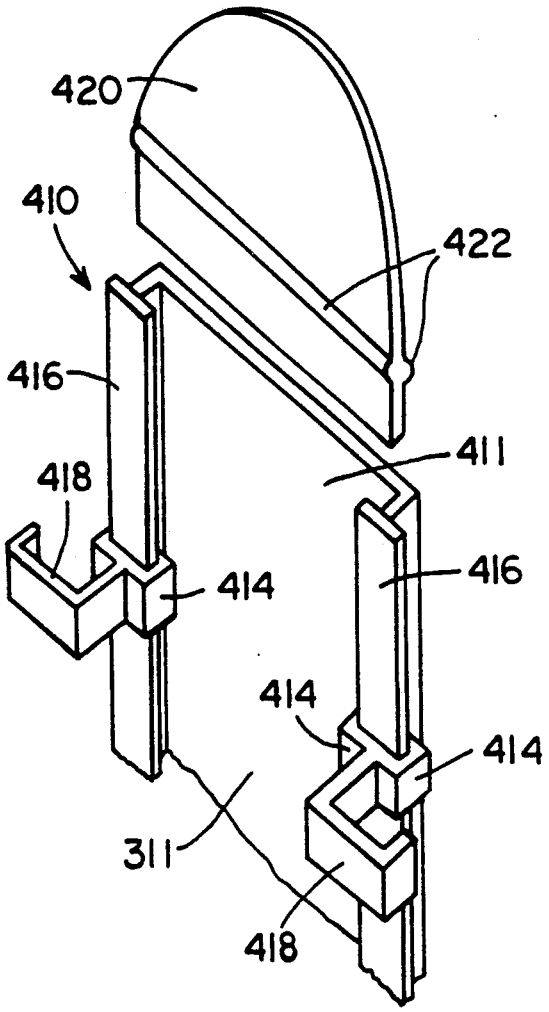
Figure 15:
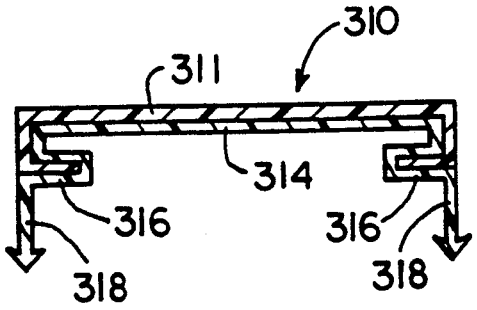
Figure 17:
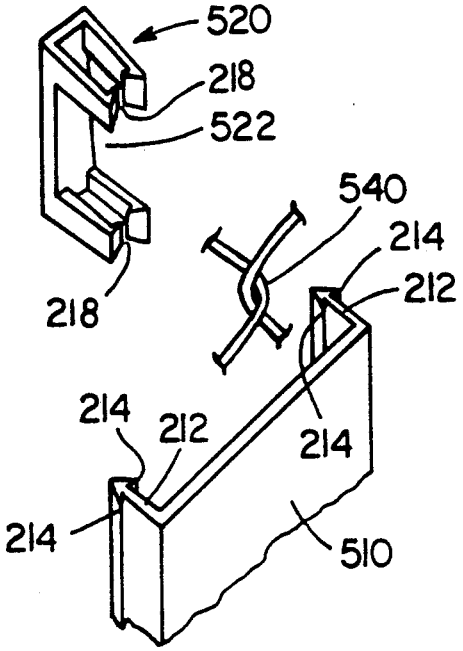
Figure 19:
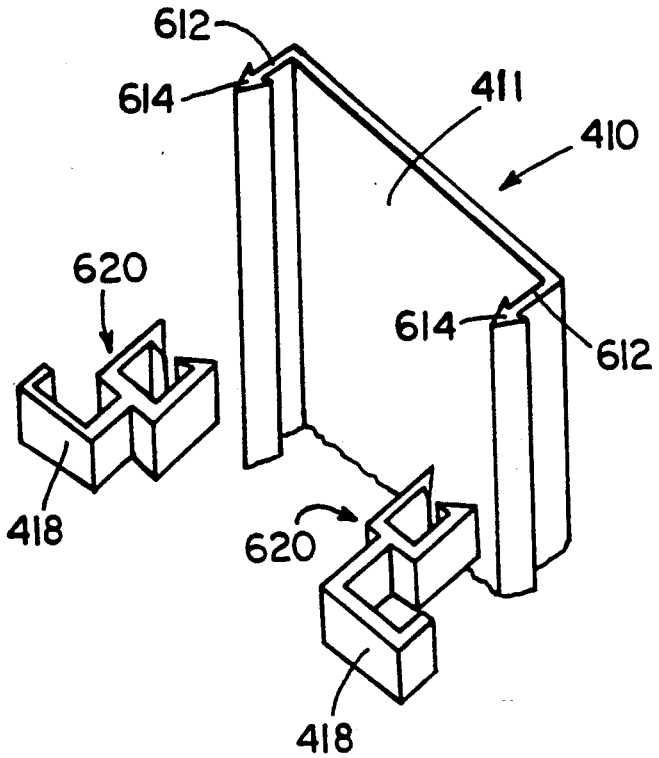
Figure 18:
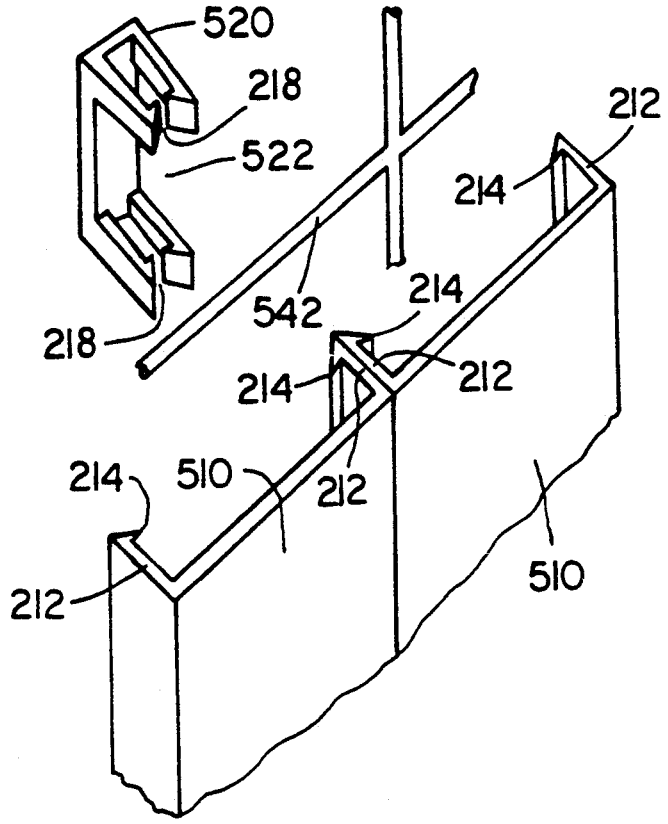

FIG. 11 is a horizontal cross section taken along the same line 2—2 as FIG. 2 but showing the picket and slat of FIG. 10 installed in the chain link fencing, FIG. 12 is a fragmentary, exploded pictorial of yet another preferred embodiment of the system of the present invention wherein a second picket similar to the first picket is positioned on the opposite side of the chain link fabric (the chain link fabric is not shown to simplify the drawing), with the second picket acting as the mounting member;

FIG. 13 is a cross section through the connector members of the picket system of FIG. 12 showing how pickets having identical construction can be inverted on opposite sides of the chain link fencing to engage with each other through the chain link fabric;

FIG. 14 is a fragmentary pictorial of another preferred embodiment in which a sliding clip member is provided on the pickets with the engagement member being incorporated in the sliding clip member;

FIG. 15 is a cross section taken along line 15—15 of FIG. 14,

FIG. 16 is a fragmentary pictorial of a similar embodiment to that shown in FIG. 14, with individual clip members that slide up and down a T-bar at the sides of the picket, with FIG. 16 also showing a top cap member that can be used with the pickets to give a finished appearance to the top of the pickets;

FIG. 17 is a fragmentary, exploded pictorial of yet another preferred embodiment of a picket and engagement member wherein the engagement members take the form of individual elongate clips that have notches cut therein, with the clips being adapted to fit over the crossover positions of the wire fabric with the crossover being received in the notch;

FIG. 18 is a fragmentary, exploded pictorial similar to that of FIG. 17 but illustrates an embodiment of the invention incorporating means for positioning pickets side-by-side on the same side of a wire fence, with elongate clips having notches that are shown fitting over any portion of the wire of a generic wire fence; and FIG. 19 is a fragmentary pictorial similar to that of FIG. 16 showing the individual clip members being of a type that can be clipped or snapped onto corresponding engagement means on the sides of the picket.

DETAILED DESCRIPTIONS OF THE PREFERRED EMBODIMENTS

Figure 1:
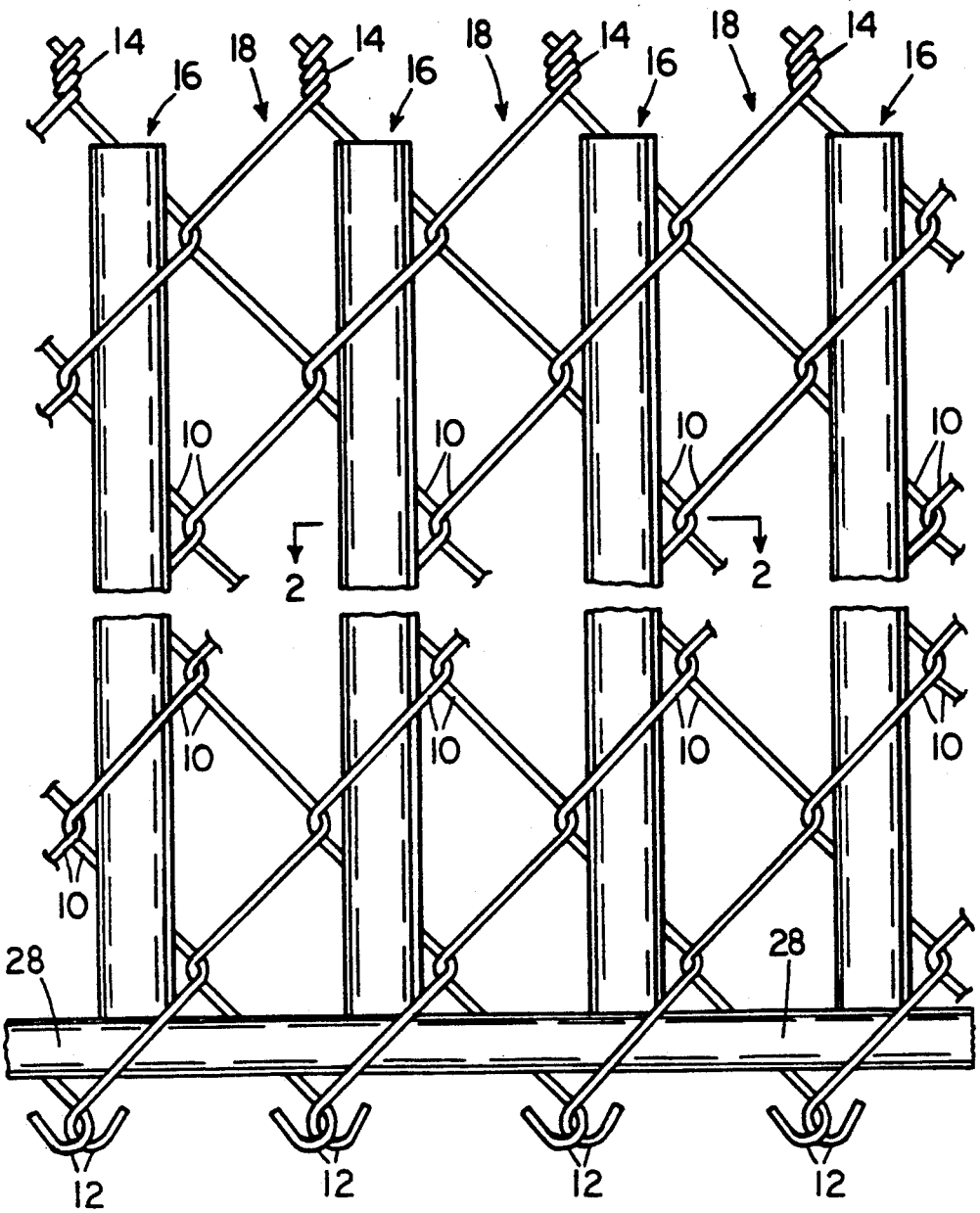
FIG. 1 is a fragmentary view in elevation of a portion of chain link fencing showing mounting members in the form of slats inserted in every other vertical channel of the chain link fabric.

One embodiment of the invention relates to conventional chain link fencing as shown in FIG. 1 in which elongate wires are bent in zig-zag manner and interlocked with one another to form a chain link fabric comprising a plurality of links 10. The bottom ends of adjacent wires of the chain link fabric may be interconnected by reversely bent end portions 12, and the upper ends of adjacent wires are interconnected by twisting the upper portions together. The twisted upper portions 14 present rather sharp barbs which discourage attempts to climb over the fence. It is the preference of some, however, to invert the chain link fabric so as to place the twisted end portions 14 at the bottom.

Figure 3:
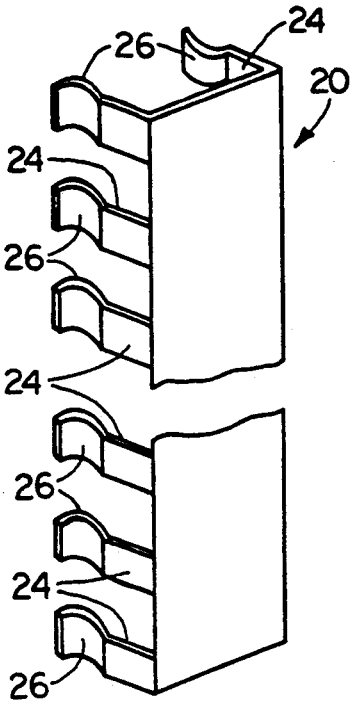
FIG. 3 is a fragmentary pictorial view of a picket member of FIG. 2.

In the embodiment of the invention shown in FIGS. 1-3, a plurality of elongate slats 16 are disposed in spaced, parallel relationship. The slats 16 are woven through the chain links 10 so as to extend vertically relative to the fence. The slats 16 slide down channels that are formed by the links 10 of the chain link fabric. In the embodiment shown in FIG. 1, the slats 16 (the slats 16 can be replaced with specially designed rails as will be disclosed hereinafter) are positioned such that there is at least one open, unoccupied channel, shown by reference numeral 18 in FIG. 1, between corresponding channels that have slats 16 (or substituted rails) received therein. The slats 16 (or substituted rails) can be made of any available material, such as wood, metal or plastics.

In the embodiment shown in FIGS. 1 and 2, the slats 16 are made of a plastic material and are formed so as to have a flattened, tubular shape as best illustrated in FIG. 2. Such slats 16 have essentially flat front and back sides or faces which are spaced apart, with the sides or faces 20 being substantially parallel to each other and in longitudinal alignment with each other. The sides are joined along mutually respective lateral edges by curved end walls to complete the elongate, tubular shape. An elongate space is enclosed within the tubular slats 16, with the space being generally open only at the ends of the slats 16.

As best shown in FIGS. 2 and 3, elongate picket members 20 are provided that lie adjacent to one of the side faces of the chain link fencing so as to be substantially superposed over the open, unoccupied channels 18 of the chain link fencing. Engagement means are provided in combination with the picket members 20 for engaging the respective slats 16 (or substituted rails to be described hereinafter) to thereby hold the picket members 20 firmly in place and prevent removal of the picket members 20 or the slats 16.

The picket members 20 can be made of any available material, such as wood, metal and plastics. Preferably, the picket members 20 are extruded from thermoplastics. The engagement means extend from the opposite longitudinal sides of the picket members 20 into the chain link fencing to engage the respective slats 16 (or substituted rails). As shown in FIGS. 2 and 3, the engagement means advantageously comprises spaced apart extensions 24 that are positioned along the length of the sides of the picket members 20. The extensions 24 project from the picket members 20 into the chain link fencing adjacent to the respective slats 16 (or substituted rails). The extensions 24 are spaced along the picket members 20 so that the extensions 24 will fit into the chain link fabric without interference from the bent back portion of the links 10 of the chain link fabric.

The extensions 24 preferably make spring engagement with the slats 16 (or substituted rails) such that once installed it is difficult to remove the picket members 20. For this purpose, the extensions 24 of the embodiment shown in FIGS. 2 and 3 project substantially transversely of the picket member 20, and the extensions 24 can have curved end portions 26 that curve around the side edges of the respective slats 16. In installing the picket members 20, the member is compressed in the area of the extensions 24 that are being inserted in the fencing so that the ends of a respective pair of extensions 24 snap in around the slat 16. The next pair of extensions 24 are then worked into place until the entire picket member 20 is properly installed. Once installed, it has been found difficult to squeeze the picket member 20 sufficiently for it to release one or more of the pairs of extensions 24. The cumulative effect of all the pairs of extensions 24 and the longitudinal rigidity of the picket members 20 provide more than adequate resistance to removal of the picket members 20 so that vandalism is essentially eliminated. If additional resistance to sliding of the slats 26 relative to the pickets is desired, one or more of the extensions 24 can be glued to the slats 26 when the pickers are installed. Various cements and glues are commercially available for this purpose.

Figure 4:
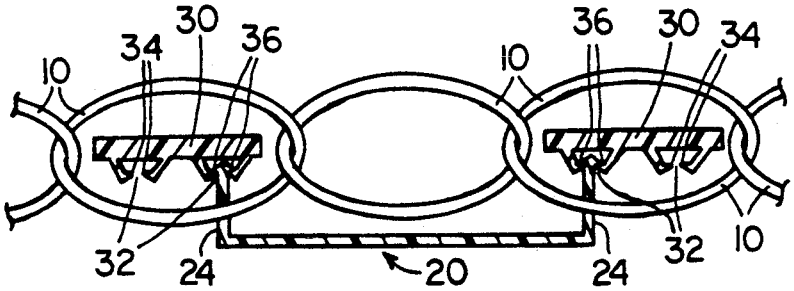
FIG. 4 is a cross section similar to that of FIG. 2 but showing rails that can be used in place of the slats of FIG. 2, with the rails incorporating one preferred embodiment of engagement means for engaging the corresponding picket members.
Figure 5:
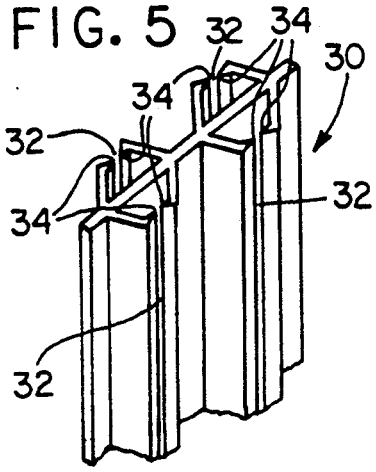
FIG. 5 is a fragmentary pictorial view of a rail of FIG. 4.
Figure 6:
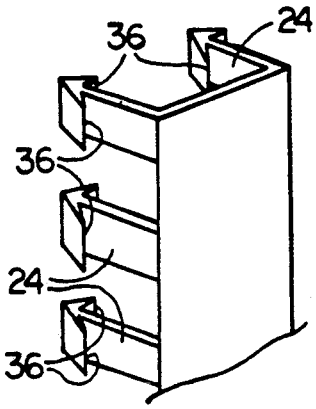
FIG. 6 is a fragmentary pictorial view of the picket member used with the rail of FIG. 4, showing a preferred embodiment of engagement means associated with the picket member for engaging the corresponding rail.

As mentioned above, the slats 16 of the embodiment shown in FIGS. 1 and 2 can be replaced or substituted with specially designed rails. Advantageously, the rails can be formed so as to have the capability of making positive, interlocked engagement with the pairs of extensions 24 on the picket members 20 to positively lock the picket members 20 and the rails together. As shown in FIGS. 4 and 5, the rails 30 are elongate members capable of being inserted in the channels of the chain link fence in the same manner as the slats 16 of FIG. 1.

The rails 30 have an elongate aperture 32 extending substantially full length of the rails 30, and as shown in FIG. 4, the otherwise free ends of the extensions 24 of the picket members 20 engages the apertures 32 in the respective rails 30. To provide for positive, locking engagement, the apertures 32 in the rails 30 have an elongate lip 34 that extends inwardly at the margin of the elongate apertures 32. The extensions 24 on the picket members 20 have barbs 36 formed near the free ends thereof. The barbs 36 can be readily inserted into the apertures 32 and then positively engage and interlock with the lips 34 of the apertures 32 to prevent withdrawal of the barbed end of the extensions 24 from the apertures 32.

As shown in FIG. 4, the rail 30 comprises an elongate, solid slat having the apertures 32 formed on only one side thereof. The picket members 20 can thus be positioned on only one side of the fence fabric. In FIG. 5, a modified rail 30 is shown in which the apertures 32 are formed on both sides of the solid, elongate slat. This latter embodiment allows picket members 20 to be installed on both sides of the fence fabric.

Figure 9:
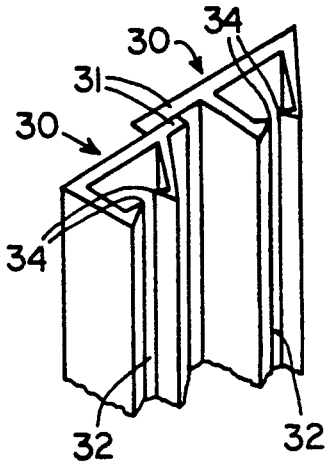
FIG. 9 is a fragmentary pictorial view of yet another rail similar to that of FIG. 7 but being of two pieces that can slide relative to each other to compensate for slight variances in the size of the openings or channels in the chain link fencing.
Figure 7:
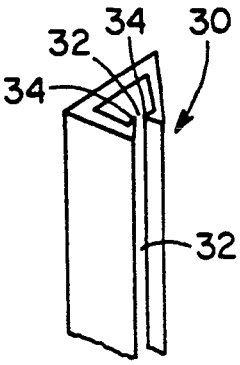
FIG. 7 is a fragmentary pictorial view of a modified rail that is employed in pairs in respective channels of the chain ling fence.

It is sometimes advantageous to divide the rail 30 into two elongate pieces that are inserted as pairs in the channels of the fence fabric. The two pieces allow a floating type adjustment such that the picket members 20 can be used on fence fabrics having a range of sizes of the channels formed by the links 10 of the fence fabric. Two of the pieces are inserted in each channel that is to contain such rails. Each elongate rail piece 30, as shown in FIG. 7, has an elongate aperture 32 extending substantially full length of the piece 30 for receiving the extensions 24 of a respective picket member 20. When a two piece rail is being used it is advantageous as shown in FIG. 9 to provide planar extensions 31 on the bases of the rail pieces 30. The two pieces 30 can move laterally sliding along the planar extensions 31 to adjust to different widths of channels or openings that are encountered with different sized chain link fabric. The planar extensions 31 slide along each other and prevent an opening being formed between the pieces 30. Thus, complete privacy is maintained.

Figure 8:
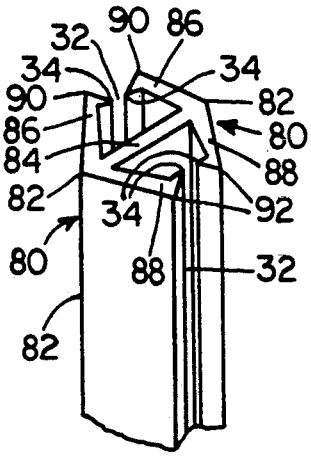
FIG. 8 is a fragmentary pictorial view of a rail similar to that of FIG. 7 but adapted to receive picket members from both flat faces or sides of the chain link fence, or when turned sideways, to receive adjacent picket members from the same side face of the chain link fence.

The piece 30 as shown in FIG. 7 allows picket members 20 to be positioned on only one side of the fence fabric. To accommodate picket members 20 on both sides of the fence fabric, the piece 30 is modified as shown in FIG. 8 so as to have oppositely facing apertures 32. The embodiment of the rail 30 shown in FIG. 8 will permit picket members 20 to be positioned on both sides of the fence fabric. Alternatively, the rail 30 of FIG. 8 can be turned sideways so that the oppositely facing apertures face in the direction along the length of the fencing. The apertures can then receive extensions from adjacent pickets located on the same side of the fence.

As illustrated in FIG. 8, the rail 30 has a pair of elongate V-shaped members 80 positioned at the opposite side edges of a planar member 84 that forms the rail 30. The V-shaped members 80 each have an apex 82 that is integrally connected to an opposite side edge of the planar member 84. Each of the V-shaped members 80 have first and second sides 86 and 88 that project from the apex thereof. The sides 86 and 88 of each of the V-shaped members 80 in turn have first and second free edges 90 and 92 that are spaced from the apex 82.

The first sides 86 of the V-shaped members 80 extend from one side of the member 84 and slant towards each other, so that the first free edges 90 thereof form an elongate aperture extending substantially the full length of the first side of the member 84 that forms the rail 30. The second sides 88 of the V-shaped members 80 extend from the other side of the member 84 and slant toward each other, so that the second free edges 92 thereof form an elongate aperture extending substantially the full length of the second side of the member 84 that forms the rail 30.

The apertures 32 of the embodiments of rails 30 shown in FIGS. 7 and 8 are advantageously provided with engagement lips 34 at the margins of the apertures for positive, locking engagement with corresponding barbs 36 of the extensions 24 on the pickets members 20. As shown in FIG. 1, a bottom slat or rail 28 can be inserted at the bottom of the fence fabric as is well known in the art to form a base for the slats 16 or rails 30 to rest when inserted into the channels of the fence fabric.

A particularly preferred embodiment of pickets and mounting members in the form of flat slats that are designed for installation in a chain link fence are shown in FIGS. 10 and 11. The pickets 110 comprise a planar sheet 112 having a front face, a back face, apposite side edges and a top and bottom edge.

Engagement members 114 extend in substantially the same direction from the apposite, longitudinal sides of the sheet 112 so that the engagement members 114 extend into the chain link fencing when the sheet 112 of the picket 110 is positioned adjacent to a side face of a chain link fencing 116 as shown in FIG. 11.

The engagement members 114 are advantageously formed from L-shaped flanges that extend from the opposite sides of the sheet 112. The respective legs 118 of the L-shaped flanges extend in the same direction from the back face of the sheet 112. The legs 118 are preferably parallel to each other and form right angles with the sheet 112. The bases 120 of the L-shaped flanges extend outwardly in opposite directions away from the respective sides of the sheet 112. The bases 120 preferably extend from the legs 118 at right angles thereto, with the bases 120 lying in a common plane.

The engagement members 114 are formed in the L-shaped flanges by cutting spaced apart notches 122 in the L-shaped flanges. An elongate lip 124 extends from the otherwise free edges of the bases 120 of the remaining L-shaped flange sections forming the engagement members 114. The lips 124 extend in a direction toward a plane through the sheet 112. The engagement members 114 thus formed have the shape of broad L-shaped hook members extending from the legs 118 of the L-shaped flanges.

The width of the broad hook members forming the engagement members 114 can vary widely depending on the size of the chain link fence on which the pickets 110 are to be used. Generally, to produce a picket that is useful for employment with a range of sizes of chain link fencing, the width of the hook members forming the engagement members 114 will be between about 1 and 1.5 inches. The width of the notches 122 between the engagement members 114 is at least as great as the width of the engagement members 114 and can be up to twice or three times the width of the engagement members 114.

The elongate mounting members used with the pickets 110 of FIGS. 10 and 11 are substantially flat slats 126 having means for engaging with the engagement members 114 of the pickets 110. As illustrated, the means for engagement with the engagement members 114 comprises elongate ledges or lips 128 positioned along opposite sides of the slats 126. When the slats 126 are woven through the chain link fencing 116 as shown in FIG. 11, the lips 124 of the hook means of the engagement members 114 interengage with the lips or ledges 128 on the slats 126.

In installing the pickets 110 and slats 126 of FIGS. 10 and 11 in a chain link fence, a slat is first woven into the chain link fencing. One side of a picket 110 is moved in an arcuate hooking movement into the fencing to interengage the lips 124 on the lead side of the picket 110 to the lips or ledges 128 of the slat 126. The trailing side of the picket is then moved toward the fencing so that the engagement members 114 are positioned in a channel of the chain link fencing. A subsequent slat 126 is then woven into the channel of the chain link fencing containing the engagement members 114 of the picket 110 so that the lips or ledges 128 engage the lips 124 of the engagement members 114. Additional pickets 110 and slats 126 are installed in the chain link fencing by repeating these steps.

To prevent easy sliding and removal of the slats 126 from the chain link fencing, notches 130 can be provided in the lower ends of the slats as shown in FIG. 10 A lower rail 28 (FIG. 1) is then positioned along the bottom of the fencing as is well known in the art described in the prior art patents disclosed hereinabove. A further description of the lower rail 28 is not given herein inasmuch as such a rail and its purpose are fully described in the prior art patents mentioned previously. As is well known in the art, the notches 130 can be received and engaged in the lower rail.

If a lower rail is not desired, the removal of slats 126 can easily be prevented by applying a glue or cement to several of the engagement members 114 during the installation of the pickets 110 and slats 126 in the chain link fencing. The glue or cement can be any commercially available material that will bond the engagement members 114 to the slats 126. The engagement members 114 to which cement or glue is applied bond firmly to the Blat 126 which the engagement members 114 contacts. When bonded to the pickets 110, the slats 126 and pickets 110 can not be removed from the fencing short of destruction of both the pickets 110 and the slats 126. Alternatively, the pickets and slats can be attached together using screws, pop rivets or other equivalent attachment means.

When the installation of the pickets 110 and slats 126 comes to a post in the fencing system (no post is shown in the drawings), there is generally encountered a space of varying width comprising a hanger system attaching the chain link fabric to the post. It has been found that the pickets 110 can be easily modified to cover this space next to the post. The opposite side of the picket o the side thereof that will abut the post is installed in the fencing as described above, and the side of the picket 110 abutting the post is then attached to the post by drilling holes through the picket 110 and the post. Self-threading screws are then are inserted through the holes in the picket 110 to engage the holes in the post and thereby hold the picket 110 firmly to the post.

To accommodate various widths of the space to be covered by the end picket abutting the post, a plurality of parallel, elongate, spaced apart, narrow, guide projections 136 are formed on the back side of the sheet 112 of the picket 110. The spaced, elongate projections 136 can then be conveniently used to guide a knife therealong to score the sheet 112 for breaking the sheet 112 along the score line into two smaller sheets, one which is of the desired width to cover the space adjacent to the post in the fencing.

Another preferred embodiment of the system of the present invention is shown in FIGS. 12 and 13. In this embodiment, the means for retaining the picket members 210 in the chain link fencing comprises mounting members that lie adjacent to a second side of the chain link fencing opposite the first side face to which the picket members lie. The mounting members have engagement members that extend into the chain link fencing from an opposite side of the fencing to make engagement with similar engagement members extending from the picket members.

It is especially preferred and most advantageous to have the picket members themselves act as the mounting members. In this case, as shown in FIGS. 12 and 13, picket members 210 are positioned on both sides of the fencing. The engagement members extend from the pickets 210 and engage corresponding engagement members in the respective pickets 210 on the other side of the fencing.

To make universal pickets 210 that can be used on either side of the fencing, first engagement members 212 extend from respective first sides of the pickets 210. The first engagement members 212 have pointed ends with barbs 214. Second engagement members 216 extend from the respective second sides of the pickets 210. The second engagement members 216 have apertures 18 that can receive the pointed ends and barbs 214 of the first engagement members 212 of an adjacent picket 210 when the adjacent picket lies on the opposite side face of the chain link fencing. As is shown in FIGS. 12 and 13, the pickets 210 on both sides of the fencing are identical in construction. To make the pickets 210 fit together, all that is necessary is to invert the pickets 210 on one side of the fencing relative to the pickets 210 on the other side of the fencing.

Another preferred embodiment of the system of the present invention similar somewhat to the system of FIGS. 12 and 13 is shown in FIG. 17. In this embodiment, the means for retaining the picket members 510 in the chain link fencing comprise mounting members in the form of individual, elongate notched clips 520 that lie adjacent to a second side of the chain link fencing opposite the first side face to which the picket members 510 lie.

The notched clips 520 have engagement members that extend into the chain link fencing from an apposite side face of the fencing to make engagement with similar engagement members extending from the picket members 510. As shown in FIG. 17, the notched clips 520 have a notched out portion 522 cut out of the engagement members that extend from the clips 520. The notched out portion fits around and over the crossover positions 540 of the wire fabric fencing. Thus, the picket members 510 are held firmly to the fence fabric by the clip members 520. As many clips 520 can be used as needed to firmly secure the picket members 510 to the fence.

As shown in FIG. 17, the engagement means formed along the opposite side edges of the picket members 510 are of the female engagement type similar to the female engagement means shown on pickets 210 of FIGS. 12 and 13. The female engagement means receive male engagement type barbs on the engagement members extending from the clips 520. The male engagement means as shown in FIG. 17 are similar to the male engagement means shown on pickets 210 of FIGS. 12 and 13. It could just as well be that the engagement means formed on the picket members 510 could be of the male engagement type, with the engagement members of the clips 520 being of the female engagement type.

An embodiment similar to that shown in FIG. 17 is illustrated in FIG. 18 wherein the pickets 510 can be positioned in side-by-side, abuting position, and the fence is shown as a generic wire fence. The pickets 510, when placed side-by-side, are designed so that each of the two abuting side engagement members 212 have a single barb 214 extending away from opposite sides of the members 212 that lie adjacent to each other. The barb 214 extends backwards toward the picket 510. When two pickets are positioned side-by-side, the flat sides of the engagement members 212 lie adjacent to each other and the respective barbs 214 form arrow points at the free ends of the engagement members 212. The two oppositely extending barbs 214 of each pair of adjacent side members 212 are engaged by notched clips 520 similar to those described above with reference to the embodiment of the invention illustrated in FIG. 17. As shown in FIG. 18, the pickets 510 are positioned along the side of any generic wire fence, including fences made of welded wire mesh or chain link fabric. The clips 520 are positioned so that the notched out portions 522 fit around any portion of the wire of the fencing 542.

Because of the variation in the size of chain link fabric, it is advantageous in some instances to provide picket members that have a plurality of adjustable engagement members provided at the opposite longitudinal sides of the picket members. The engagement members can then be moved along the longitudinal sides of the picket members so that the engagement members can be spaced apart to be received in the open spaces of various sized chain links of chain link fencing.

One embodiment of pickets having adjustable engagement members is shown in FIGS. 14 and 15. The picket 310 is formed from a flat sheet 311 and the longitudinal sides of the flat sheet 311 are turned back to form longitudinal, in turned channels 312 (FIG. 14) extending along the longitudinal sides of the picket 310.

The adjustable engagement members comprise units that slide up and down in the channels 312. As shown, the adjustable members have an elongate member 314 that extends between the channels 312. Outwardly facing channels 316 are formed in the opposite ends of the elongate member 314. The outwardly facing channels 316 fit snugly around the inner extending flange of the channels 312 in the picket 310. The actual engagement members 318 extend outwardly from the channels 316 and can move up and down along the picket 310 as the member 314 and channels 316 slide along the picket 310.

Another embodiment of pickets having adjustable engagement members is shown in FIG. 16. As shown in this embodiment, the picket 410 is formed from a flat sheet 411 and the longitudinal sides of the flat sheet 411 have T-bar rails 416 formed therealong. The adjustable engagement members comprise units that slide up and down the T-bar rails 416. Other rail shapes, such as L-shaped rails or ball-shaped rails, can be used in place of the T-bar rails. As shown, the adjustable members have a C-shaped clamp-slider 414 that fits around the T-bar rail 416 and slides therealong. The actual engagement members 418 extend outwardly from the sliders 414 and can move up and down along the picket 410 as the sliders 414 slide along the T-bar rails 416. As can be seen from FIGS. 14–16, the engagement members 318 and 418 of the sliding, adjustable members can take the form of any of the engagement elements used in the other embodiments of the invention.

A still further embodiment of pickets having adjustable engagement members is shown in FIG. 19. The picket in this embodiment is similar to the picket 410 of FIG. 16 and is identified by the same reference number 410. The picket 410 is formed from a flat sheet 411, but instead of having T-bar rails formed therealong, the flat sheet 411 has elongate lips 612 extending along the opposite side edges of the sheet 411. The lips 612 of the embodiment shown in FIG. 19 extend in the same direction from each side edge of the sheet 411 in planes that are essentially perpendicular to the sheet 411. Each lip 612 has a male engagement member such as arrow-pointed barbs 614 formed along the free edge of the lip 612.

In the embodiment shown in FIG. 19, the engagement members 418, instead of having clamp-slider elements 414 as shown in FIG. 16, have female engagement members 620 that are similar to the female engagement means shown on pickets 210 of FIGS. 12 and 13. The female engagement means receives the arrow-pointed barbs 614 on the pickets 410. In this embodiment, the engagement members 41B can be positioned anywhere along the length of the picket and thus can be positioned so as to fit in an open space in the fencing between wires of the fencing. It should be recognized that female engagement means could be provided along the lips 612 of the pickets 410 and that a corresponding male engagement means could be provided on the engagement members 418. In fact, any type snapping or clamping engagement could be used to engage the engagement means 41B at selectable positions along the lips 612 of the pickets 410.

Another advantageous feature that can be incorporated into the pickets such as those shown in FIGS. 10, 14 and 16 that have an in facing channel along the longitudinal sides is a top cap that provides a finished appearance to the tops of the pickets. As shown in FIG. 16, the top caps 420 comprises a substantially flat blank having the width of the picket 410 between the inside sides of the channel formed at the side edges of the picket 410. The lower edges of the cap 420 can be tapered inwardly to accommodate being slid into the channels at the opposite sides of the picket 410, and a stop ridge 422 can be provided on the tapered, lower end of the cap 420 to engage the top edges of the picket 410 to provide proper and uniform alignment of all top caps relative to their respective pickets in the fencing. The top of the cap 420 can be given any decorative shape as desired. As shown in FIG. 16, the top of the cap 420 has a circular shape.

The cap 420 fits snugly within the channels at the sides of the picket 410. Frictional engagement can be used to retain the cap 420 in place, but it is advantageous to also use a glue or cement to firmly bond the cap 420 to the picket 410.

It is to be understood that the present disclosure, including the detailed description of preferred embodiments, is made by way of example and that various other embodiments are possible without departing from the subject matter coming within the scope of the following claims, which subject matter is regarded as the invention.

We claim:

1. Chain link fencing having a plurality of elongate mounting members inserted in elongate channels of the chain link fencing;

a plurality of elongate picket members that lie adjacent to a side face of the chain link fencing so as to be substantially superposed over the side face of the chain link fencing; and engagement means that extend from the opposite, longitudinal sides of the elongate picket member into the chain link fencing to engage respective mounting members to thereby hold the picket members in place on the side face of the chain link fencing.

2. Chain link fencing in accordance with claim 1 wherein the engagement means comprises spaced apart extensions positioned along the length of the sides of the picket members to project from the picket members into the chain link fencing to make engagement with the respective mounting members.

3. Chain link fencing in accordance with claim 2 wherein the extensions project substantially transversely of the picket members and the extensions have end portions that curve outwardly from the picket members such that the extensions can make spring engagement with the side edges of the respective mounting members, with the curved end portion lying in locked position along the back side of the mounting members.

4. Chain link fencing in accordance with claim 1 wherein each mounting member has an elongate aperture extending substantially the full length of the mounting member, and said engagement means comprises spaced apart extensions positioned along the length of the sides of the picket members to project from the picket members into the chain link fencing and engage an aperture in a respective mounting member.

5. Chain link fencing in accordance with claim 4 wherein said aperture in each said mounting member has an elongate lip at a margin of the aperture, and said extensions have barbs near the free ends thereof that interlock with said lip when the ends of said extensions engage said aperture.

6. Chain link fencing in accordance with claim 4 wherein two mounting members are inserted in each of a plurality of the channels in said fencing and there is at least one open, unoccupied channel between the channels containing mounting members.

7. Chain link fencing having a plurality of elongate picket members that lie adjacent to a first side face of the chain link fencing so as to be superposed over said first side face of said chain link fencing;

engagement members that extend from the opposite, longitudinal sides of each of the picket members into the chain link fencing; and means for retaining the engagement members in the chain link fencing, wherein the means for retaining the engagement members in the chain link fencing comprises elongate mounting members inserted in elongate channels of the chain link fencing, with the mounting members having means for engaging with the engagement members.

8. Chain link fencing in accordance with claim 10 wherein end portions of the engagement members that extend into the chain link fencing have hook means at the free end thereof;

said elongate mounting members are substantially flat slats; and the means for engagement with the engagement members comprises elongate ledges or lips positioned along opposite sides of said slats, so that the hook means of said engagement members interengages with the elongate ledges or lips on said slats.

9. Chain link fencing in accordance with claim 11 wherein notches are provided adjacent to the lower ends of said elongate mounting members; and a lower rail is positioned along the bottom of the fence, with the lower rail having means for grasping the notches in said elongate mounting members to retain the mounting members in said chain link fencing.

10. Chain link fencing in accordance with claim 7 wherein end portions of the engagement members that extend into the chain link fencing have barb means at the free end thereof; and the means for engagement of the mounting members with the engagement members comprises elongate apertures extending substantially the full length of the mounting members, whereby the end portions of said engagement members penetrate into said elongate apertures and the barb means at the free end of the end portions of said engagement members prevents withdrawal of the penetrating end portions from said apertures.

11. Wire fencing having a plurality of elongate picket members that lie adjacent to a first side face of the wire link fencing so as to be superposed over said first side face of said wire link fencing;

engagement members that extend from the opposite, longitudinal sides of each of the picket members into the wire fencing; and means for retaining the engagement members in the wire fencing comprising mounting members that lie adjacent to a second side face of the wire fencing opposite the first side face to which the elongate picket members lie; and second engagement members that extend into the wire fencing from opposite sides of said mounting members, with the engagement members extending from said picket members making interlocking engagement with the second engagement members extending from said mounting members.

12. Wire fencing in accordance with claim 11 wherein the mounting members are elongate picket members similar to the elongate picket members lying adjacent to said first side face of said fencing.

13. Wire fencing in accordance with claim 15 wherein all the pickets have the same construction.

first engagement members extend from respective first sides of said pickets;

said first engagement members have pointed ends with barbs;

said second engagement members extend from respective second sides of said pickets; and said second engagement members having apertures that can receive the pointed ends of the first engagement members of an adjacent picket when the adjacent picket lies on the opposite side face of said wire fencing.

14. Wire fencing having a plurality of elongate picket members that lie adjacent to a first side face of the wire link fencing so as to be superposed over said first side face of said wire link fencing;

a plurality of engagement members that extend from each of the opposite, longitudinal sides of each picket member, with the engagement members being slidable up and down along the sides of the picket members such that the engagement members can be spaced apart at proper spacings to be received in the openings of various sized openings in the wire fencing; and means for retaining the engagement members in the wire fencing.

15. An elongate picket that is to be positioned adjacent to a side face of wire fencing, said picket comprising an elongate, substantially planar sheet having a front face, a back face, apposite side edges, a top edge and a bottom edge; and engagement members extending in substantially the same direction from the back face of said sheet so that the engagement members extend into the wire fencing when said sheet is positioned adjacent to a side face of the wire fencing.

16. An elongate picket in accordance with claim 15 further comprising a plurality of parallel, elongate, spaced apart, narrow projections formed on the back face of said sheet that is to face said side face of the wire fencing, whereby the spaced, elongate projections can be used to guide a knife therealong to score the sheet for breaking the sheet along the score line into two smaller sheets.

17. An elongate picket in accordance with claim 15 wherein said engagement members extend from opposite longitudinal sides of said sheet.

18. An elongate picket in accordance with claim 17 wherein said engagement members comprise L-shaped flanges extending from the opposite sides of said sheet, with the respective legs of the L-shaped flanges extending in the same direction away from the back face of said sheet, and with the bases of said L-shaped flanges extending in opposite directions away from the respective sides of said sheet;

an elongate lip extends from the otherwise free edges of the bases of said L-shaped flanges in a direction toward a plane through said sheet; and a plurality of spaced apart engagement members are formed by cutting spaced apart notches in said L-shaped flanges.

19. An elongate picket in accordance with claim 18 wherein first engagement members extend from one of the opposite side edges of said sheet, said first engagement members having pointed ends with barbs; and second engagement members extend from a second of the opposite side edges of said sheet, said second engagement members having apertures that can receive the pointed ends of the first engagement members of an adjacent picket.

20. An elongate picket in accordance with claim 18 wherein the engagement members comprise a plurality of spaced apart projections having pointed ends with barbs extending from the pointed ends back toward a plane through said sheet.

* * * * *